United States Patent [19]

Kitchen

[11] 4,433,224

[45] Feb. 21, 1984

[54] ACTUATOR MECHANISM WITH ENHANCED TACTILE CHARACTERISTICS

[75] Inventor: Robert D. Kitchen, Freeport, Ill.

[73] Assignee: Honeywell Inc., Minneapolis, Minn.

[21] Appl. No.: 435,010

[22] Filed: Oct. 18, 1982

[51] Int. Cl.[3] ..... H01H 5/18

[52] U.S. Cl. ..... 200/330; 200/83 S; 200/153 T; 200/67 DB; 74/110

[58] Field of Search ..... 200/153 T, 67 DB, 340, 200/330, 835; 74/110

[56] References Cited

U.S. PATENT DOCUMENTS

| | | | |
|---|---|---|---|
| 1,676,155 | 7/1928 | Pfeifer . | |
| 2,673,468 | 3/1954 | Immel et al. | 200/153 T |
| 2,842,632 | 7/1958 | Edwards | 200/67 |
| 3,109,901 | 11/1963 | Strauss | 200/67 |
| 3,872,270 | 3/1975 | Bond | 200/67 DB X |
| 3,890,477 | 6/1975 | Saunders | 200/67 DB X |
| 4,002,871 | 1/1977 | Simms, Jr. | 200/159 |
| 4,002,879 | 1/1977 | Simms, Jr. | 200/159 |
| 4,190,751 | 2/1980 | Roth et al. | 200/67 |
| 4,267,725 | 5/1981 | Roth et al. | 200/67 DB X |

*Primary Examiner*—John W. Shepperd
*Assistant Examiner*—Renee S. Kidorf
*Attorney, Agent, or Firm*—Charles L. Rubow

[57] ABSTRACT

A push button actuator for an electrical switch device is disclosed which provides high tactile feedback with small button travel. Movement of the push button is resisted by a resilient column extending between the button and a force transfer device which is adapted to laterally engage the column in response to a sufficient force applied to the force transfer device through the column. The lateral engagement initiates buckling of the column which sharply reduces its load bearing capacity and causes the push button to snap to its depressed position.

16 Claims, 5 Drawing Figures

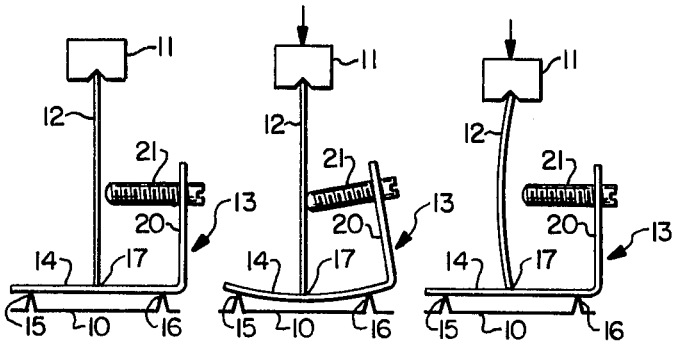
FIG. 1a FIG. 1b FIG. 1c
FIG. 2
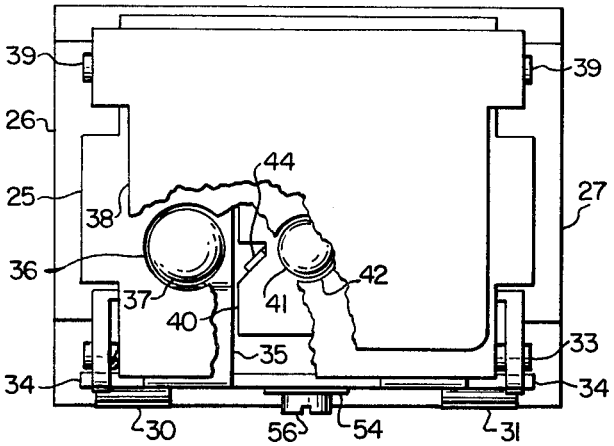
FIG. 5
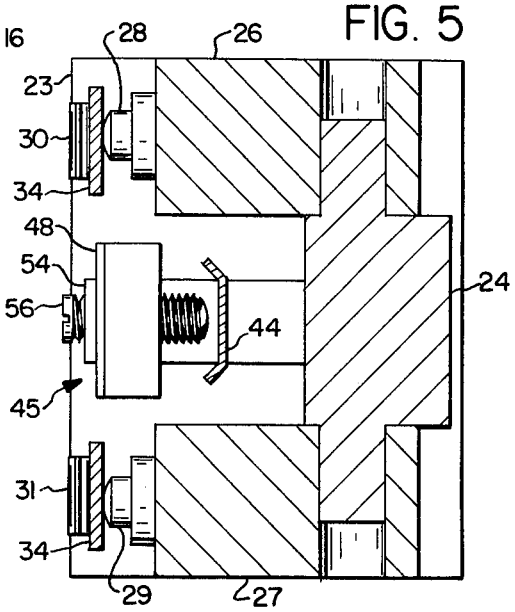
FIG. 3
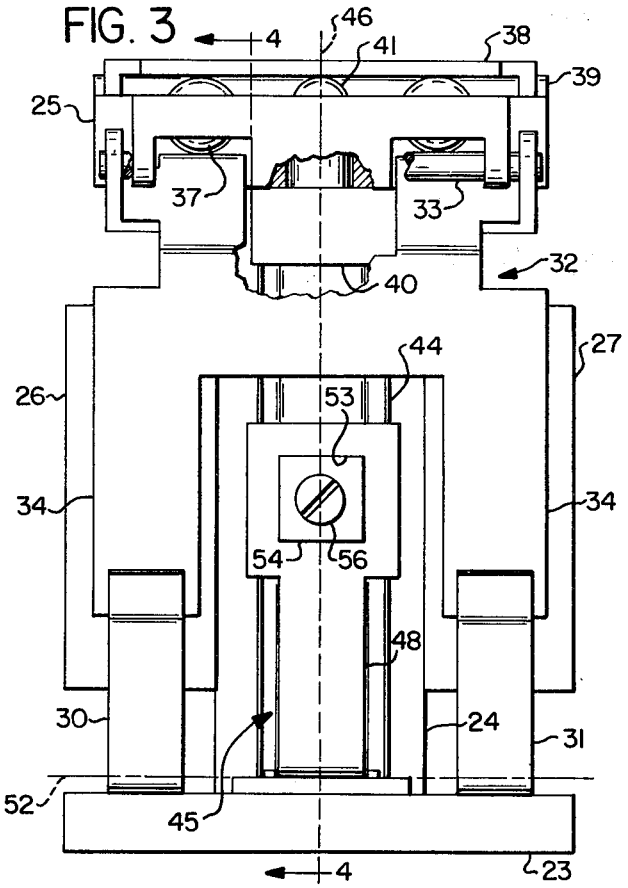
FIG. 4
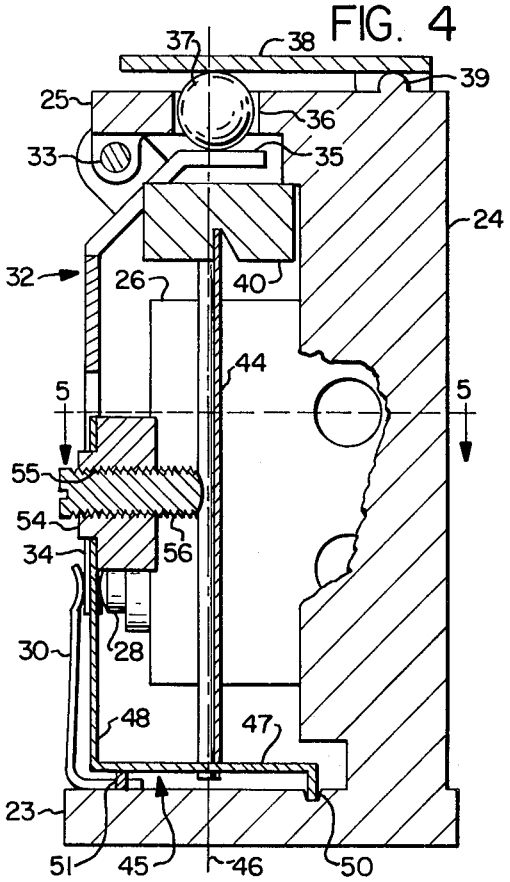

ACTUATOR MECHANISM WITH ENHANCED TACTILE CHARACTERISTICS

BACKGROUND OF THE INVENTION

The invention disclosed herein relates generally to push button actuator mechanisms, and more particularly to push button actuator mechanisms which utilize a buckling column or beam to provide high tactile feedback with small button travel.

It is well known to equip electrical switches and similar devices with push button actuators. Such actuators may be fabricated as part of the switches, or may be separately fabricated and combined with one or more switches. For various applications it is desirable to use push buttons with small button travel. In keyboards, small button travel may help to alleviate operator fatigue. Where a push button actuated switches are positioned in close proximity, such as on keyboards and various other electronic equipment, small button travel may help to minimize inadvertent actuation of switches adjacent the intended switch. Also, push button actuator designs characterized by small button travel are generally simpler, less expensive and easier to manufacture.

One disadvantage generally associated with push button actuators with small button travel is diminished tactile feedback. Lack of tactile feedback contributes to ambiguity regarding whether a button has been depressed and switch actuation achieved. A special application specifically requiring push button switch actuators with high tactile feedback is on equipment which must be operated in a severe environment in which it is necessary for the operator to wear gloves. In such a situation, the tactile feedback must be sufficient to be easily detected through a glove.

A variety of mechanisms for enhancing tactile feedback in push button actuators with small button travel have been devised. One known type of such mechanisms comprises a column to which a longitudinal force or load is applied by actuation of the push button. The column is adapted to buckle in a transverse direction upon application of a sufficient force. This results in a distinct discontinuity in the force/travel relationship of the button as it is depressed. Specifically, force of less than a predetermined magnitude determined by the longitudinal load bearing capability of the column, does not result in significant movement of the button. However, as the load bearing capability of the column is exceeded, the column buckles resulting in sharply decreased load bearing capability. This causes the button to suddenly snap to its depressed position. Even where travel of the button is limited, a definite tactile response is produced.

Push button switches employing this phenomena are disclosed in a number of U.S. patents. Representative examples are shown in U.S. Pat. Nos. 4,002,871 and 4,002,879, both issued to D. Sims, Jr. Jan. 11, 1977.

The force/travel characteristic of a push button actuator employing a buckling column is generally solely determined by the parameters of the column (i.e., the cross sectional shape and the material from which it is made) which are fixed at the time the column is fabricated. Therefore, for an actuator having a given column, it is generally not possible to adjust the force required for actuation.

It is, however, pointed out that buckling of a column depends, not only on the magnitude of the longitudinal load, but on the manner in which it is applied. Thus, any asymmetry, such as might be caused by asymmetrical pressure on the button and/or wobble of the button in its mounting structure, may affect the magnitude of applied force at which the column buckles. In many applications, it is desired or required that the force required for actuation of a push button both fall within a narrow range of magnitudes and that it be repeatable.

The applicant has devised a unique mechanization and method for both providing adjustments of the required actuation force and insuring a repeatable force/travel actuation characteristic.

SUMMARY OF THE INVENTION

The actuator mechanism of the present invention basically comprises a frame in which a plunger is mounted for movement along an axis and a resilient column extending along the axis for resisting movement of the plunger, the column being adapted to transversely buckle in response to a predetermined longitudinal load. The end of the column opposite the plunger bears on a first portion of a force transfer device having a second portion which, in response to a sufficient force applied to the first portion, transversely engages the column, causing it to buckle.

The force transfer device may comprise first and second legs, each connected to other at one end thereof in a fixed angular relationship. The first leg is resilient and is supported at first and second locations, respectively, near its ends. One end of the column engages the first leg at a third location between the first and second locations. The force transfer device is mounted in the frame such that the leg comprising the second portion extends in a direction having a component parallel with the column, and the second portion includes means for engaging the column between its ends as the first portion is flexed, causing the second portion to pivot about an axis transverse to the first and second legs. The second portion may be provided with an adjustment screw threadably engaged in the second leg and positioned to contact the column.

The method of controlling the buckling of a column to provide desired tactile characteristics in accordance with the present invention comprises applying a force longitudinally to a column adapted to buckle in a lateral direction, producing a laterally directed response to the longitudinal force and transferring at least a portion of the laterally directed response to the column at a location intermediate its ends so as to initiate buckling of the column in accordance with a desired relationship to the longitudinal force applied to the column.

BRIEF DESCRIPTION OF THE DRAWINGS

FIG. 1 is a schematic illustration of the principals of operation of the applicant's invention, showing the interrelationship of the essential elements in sequence during operation;

FIG. 2 is a plan view, partially broken away, of an electrical switch device employing a push button switch actuator in accordance with the applicant's inventions;

FIG. 3 is a front view, partially broken away, of the electrical switch device of FIG. 2;

FIG. 4 is a sectional view of the electrical switch device of FIGS. 2 and 3 taken along lines 4—4 in FIG. 3; and FIG. 5 is a sectional view of the electrical switch device of FIGS. 2–4, taken along lines 5—5 in FIG. 4.

DESCRIPTION OF THE PREFERRED EMBODIMENT

In the schematic illustration of FIG. 1, reference numeral 10 identifies a portion of a frame or housing in which various components are mounted. Reference numeral 11 identifies a push button or plunger adapted for manual operation and mounted in frame 10 for linear movement. Reference numeral 12 identifies a column or beam (hereinafter referred to as "column") aligned with the direction of movement of plunger 11, adapted to buckle in a direction transverse to its length in response to application of a longitudinal force of greater than a predetermined magnitude. Column 12 is mounted between plunger 11 and a force transfer device generally identified by reference numeral 13 so as to resist movement of the plunger.

Force transfer device 13 comprises a first portion 14 shown as a resilient leg or beam segment (hereinafter referred to as "leg") supported in housing 10 at first and second locations 15 and 16 near its ends such that the leg is positioned transversely to column 12. The end of column 12 opposite plunger 11 engages leg 14 at a third position 17 between first and second positions 15 and 16. Force transfer device 13 also includes a second leg or beam segment (hereinafter referred to as "leg") 20 connected to one end of leg 14 and extending in a direction generally parallel with column 12. A screw 21 is threadably engaged in leg 20 and positioned to extend toward column 12 at a location between the ends of the column.

FIG. 1(*a*) shows the various elements in an undisturbed state with no force being applied to plunger 11. In that state, leg 14 is shown undeflected and screw 21 is not in contact with column 12. In FIG. 1(*b*), a force is being applied to plunger 11. This force is transmitted through column 12 to location 17 on leg 14, causing the leg to flex as shown. This causes leg 20 to pivot about location 16, and bring screw 21 into contact with column 12. The force applied by screw 21 initiates buckling of column 12 as shown in FIG. 1(*c*). Once beam 12 has buckled, its load supporting capability is sharply decreased, thus reducing the force applied to leg 14. In response, leg 14 returns to its substantially unflexed state, and leg 20 pivots back to its normal position in which screw 21 is not in a position to contact column 12. Column 12 remains buckled as long as plunger 11 is depressed. Once the plunger is released, column 12 and the other illustrated elements return to the state shown in FIG. 1(*a*).

FIGS. 2–5 depict an electrical switch device with an actuator mechanism embodying the various elements and operational features illustrated in FIG. 1. The various components of the switch device are mounted on a frame or housing comprising a base 23, an attached support column 24, and a top plate 25. A pair of miniature snap acting switches 26 and 27 are mounted on opposite sides of column 24. Switches 26 and 27 are respectively equipped with actuator buttons 28 and 29 of which button 28 can be seen in FIG. 4 and buttons 28 and 29 can be seen in FIG. 5.

In the illustrated device, buttons 28 and 29 are normally maintained in a depressed position by leaf springs 30 and 31 attached to base 23 and acting on a forked lever generally identified by reference numeral 32. Lever 32 is pivotally carried on top plate 25 by means of a shaft 33, and includes a downwardly extending forked portion 34 in contact with buttons 28 and 29 and a horizontal forked portion 35 which extends transversely to portion 34. As shown, shaft 33 extends transversely to both the downwardly extending and horizontal portions of lever 32, and is located generally at the intersection of the planes containing the portions.

Horizontal forked portion 35 extends beneath top plate 25 which contains a pair of apertures of which one, identified by reference numeral 36 can be seen in FIGS. 2 and 4. The apertures serve as guides for spherical members of which the member in aperture 36 is identified by reference numeral 37. The spherical members are of sufficient diameter to extend above and below top plate 25 so as to contact horizontal forked portion 35 and a push button plate 38 on top of top plate 25. Push button plate 38 is pivotally connected along one edge to top plate 25 by means of stub shafts 39. Thus, as push button plate 38 is depressed, its motion is transmitted to horizontal portion 35 of lever 32, causing downwardly extending portion 34 to pivot against leaf springs 30 and 31 to release buttons 28 and 29 on switches 26 and 27, and actuate the switches.

Motion of push button plate 38 is resisted by means of a plunger 40 having a button 41 which extends through an aperture 42 in top plate 25 to contact the underside of push button plate 38. Plunger 40 is held in position by means of a resilient column or beam (hereinafter referred to as column) 44 which extends between a groove in the underside of plunger 40 and a force transfer device generally identified by reference numeral 45. As can be seen in FIGS. 4 and 5, column 44 is formed of a strip of resilient material having the edges of the strip slightly bent to form a modified channel. As shown, column 44 extends along an axis 46.

Force transfer device 45 comprises a first resilient beam segment or leg 47 connected at one end to a second beam segment or leg 48, with substantially a right angle between the legs. For brevity, elements 47 and 48 are hereinafter referred to as "legs". Force transfer device 45 is mounted in housing or frame 23–25 so that leg 47 is transverse to column 44 and leg 48 extends substantially parallel with column 44.

Leg 47 is pivotally supported on base 23 at two locations near opposite ends of the leg. Specifically, the end of leg 47 opposite leg 48 is bent downwardly to be positioned in a groove 50 in base 23. The end of leg 47 contiguous with leg 48 is supported on a ridge 51 on base 23. Accordingly, as the center of leg 47 is flexed downwardly under the influence of force transmitted along column 44, leg 48 is caused to pivot clockwise in FIG. 4 about an axis 52 (see FIG. 3) which extends transverse to legs 47 and 48 near the intersection of the legs.

The end of leg 48 opposite leg 47 is formed with an aperture 53 therein which is fitted with a block 54. Block 54 may be held in place by swaging it into aperture 53. Block 54 has a threaded hole 55 therethrough extending toward an intermediate location on column 44. Hole 55 is fitted with an adjustment screw 56 positioned to contact or engage column 44 at a location between its ends as leg 48 is pivoted. According, the end of screw 56 adjacent column 44 can be brought into contact with the column by depressing push button plate 38 whose motion is transmitted through plunger 40 and column 44 to leg 47 of force transfer device 45. When a predetermined force is applied to push button plate 38, screw 56 directs a force laterally against column 44, causing it to buckle in the manner illustrated in FIG. 1(*c*). Since buckling of column 44 is initiated by lateral contact from screw 56, the column can be caused to buckle in response to a smaller applied force than would be required if only a longitudinal load were applied to the column. This results in a very well defined and repeatable relationship between the force applied to push button plate 38 and travel or displacement of the plate. Further, the force/travel characteristic of the switch mechanism can be easily adjusted after fabrication of the mechanism by means of adjusting screw 56.

In actual practice, the illustrated switch mechanism would be contained in an additional housing including a face plate embodying such functions as legends and lighting. These features have been omitted in the present description to avoid confusing the disclosure of the essential structure and features of the applicant's invention.

Although a single embodiment of the applicant's invention has been shown and and described in detail, along with the unique method of the invention for illustrative purposes, other variations and embodiments which do not depart from the applicant's teachings will be apparent to those skilled in the relevant arts. It is not intended that coverage of the invention be limited to the disclosed embodiments, but only by the terms of the following claims.

I claim:

1. An actuator mechanism with enhanced tactile characteristics, comprising:

a frame;

a resilient column mounted in said frame aligned with and adapted to accept a force along a first axis; and force transfer means mounted on said frame and having a first portion for receiving a force along the first axis from said resilient column and a second portion for responsively applying a force transverse to the first axis to said resilient column at an intermediate location thereon, said resilient column being adapted to buckle in a direction transverse to the first axis and positioned to be deflected by the second portion of said force transfer means when a predetermined force is applied to the first portion thereof, whereby buckling of said resilient column is repeatably controlled.

2. The actuator mechanism of claim 1 wherein:

the first portion of said force transfer means comprises a first leg normally extending along a second axis transverse to the first axis;

the second portion of said force transfer means comprises a second leg extending in a direction having a component parallel with the first axis; and said force transfer means is mounted in said frame for pivotal movement of at least a portion of said force transfer means about a third axis transverse to the first and second axes.

3. The actuator apparatus of claim 2 wherein said force transfer means is positioned so that the intersection of the first and second legs is proximate the third axis.

4. The actuator apparatus of claim 3 including a plunger mounted in said frame for movement along the first axis and adapted to apply force longitudinally to said resilient column.

5. The actuator apparatus of claim 4 wherein:

the first leg of said force transfer means is resilient;

said force transfer means is mounted in said frame so as to be supported substantially only at areas proximate opposite ends of the first leg; and said resilient column extends from said plunger to an area on the first leg intermediate the areas at which the first leg is supported in said frame.

6. The actuator apparatus of claim 1, 3 or 5 wherein the second portion of said force transfer means includes adjustable means for contacting said beam so as to permit variation of the plunger force required to buckle said resilient column.

7. The actuator apparaus of claim 6 wherein said adjustable means comprises a screw extending transverse to the first axis and threadably engaging the second leg of said force transfer means.

8. The actuator mechanism of claim 7 further including an electrical switch adapted to be actuated upon buckling of said resilient column.

9. The actuator mechanism of claim 1, 3 or 5 further including an electrical switch adapted to be actuated upon buckling of said resilient column.

10. A method of controlling the buckling of a column which provides desired tactile characteristics in an actuator, comprising:

applying a force longitudinally to a column adapted to buckle in a lateral direction;

producing a laterally directed response to the longitudinal force applied to the column; and transferring at least a portion of said laterally directed response to the column at a location intermediate its ends so as to initiate buckling of the column in accordance with a desired relationship to the applied force.

11. The method of claim 10 wherein the portion of said lateral response transferred to the beam is adjustable.

12. An actuator mechanism with enhanced tactile characteristics, comprising:

a frame;

a plunger mounted in said frame for movement along a first axis;

force transfer means mounted on said frame and having a first portion for receiving a force along the first axis; and a resilient column extending along the first axis between said plunger and the first portion of said force transfer means for applying force to said first portion, said column being adapted to buckle in a direction transverse to the first axis;

said force transfer means also having a second portion positioned to transversely engage said column at a location intermediate said plunger and the first portion of said force transfer means so as to initiate buckling of said column when said column is subject to a predetermined force along the first axis.

13. The actuator mechanism of claim 12 wherein:

the first and second portions of said force transfer means respectively comprise first and second legs each connected to the other in a fixed angular relationship; and said force transfer means is mounted on said frame so that the first leg extends in a direction transverse to the first axis, the second leg extends in a direction having a component parallel with the first axis, and at least a portion of said force transfer means is mounted for pivotal movement about a second axis transverse to the first and second legs proximate the intersection thereof.

14. The actuator mechanism of claim 13 wherein:

the first leg of said force transfer means is resilient;

said force transfer means is supported in said frame at first and second locations respectively proximate opposite ends of the first leg; and said resilient beam extends to a third location on the first leg between the first and second locations.

15. The actuator mechanism of claim 14 wherein the second portion of said force transfer means includes a screw which is positioned to engage said resilient column and is threadably mounted in said second leg for adjustment transverse to the first axis.

16. The actuator mechanism of claim 15 further including an electrical switch adapted to be actuated by movement of said plunger.

* * * * *